US006112829A

United States Patent [19]

Hunt

[11] Patent Number: 6,112,829

[45] Date of Patent: Sep. 5, 2000

[54] ROCK DRILL AIR LEG CONTROL SYSTEM

[76] Inventor: Clive Wilfred Hunt, 72 Jan K Marais Avenue, Malanshof, Randburg, South Africa

[21] Appl. No.: 09/292,988

[22] Filed: Apr. 16, 1999

[30] Foreign Application Priority Data

Apr. 17, 1998 [ZA] South Africa ..... 98/3246

[51] Int. Cl.[7] ..... E21C 5/11

[52] U.S. Cl. ..... 173/36; 173/37; 173/158; 173/161; 173/159

[58] Field of Search ..... 173/158, 159, 173/161, 186, 44, 36, 37, 31, 4

[56] References Cited

U.S. PATENT DOCUMENTS

| | | | |
|---|---|---|---|
| 3,064,741 | 11/1962 | Morrison | 173/36 |
| 3,119,455 | 1/1964 | Fuehrer et al. | 173/36 |
| 3,245,484 | 4/1966 | Ekwall | 173/36 |
| 3,455,212 | 7/1969 | Judd . | |
| 3,533,477 | 10/1970 | Ekwall | 173/158 |
| 3,586,114 | 6/1971 | Gordon | 173/158 |
| 3,724,559 | 4/1973 | Stromnes | 173/4 |
| 4,010,819 | 3/1977 | Ekström et al. . | |
| 4,024,923 | 5/1977 | Broadbent . | |

FOREIGN PATENT DOCUMENTS

| | | |
|---|---|---|
| 0 367 875 | 5/1990 | European Pat. Off. . |
| 2 196 883 | 5/1988 | United Kingdom . |

*Primary Examiner*—Scott A. Smith
*Attorney, Agent, or Firm*—Burns, Doane, Swecker & Mathis, LLP

[57] ABSTRACT

The invention relates to a rock drill air leg control system incorporated in the backhead (10) of a rock drill. The system comprises a single spool valve (22) having two manual controls (46, 53), one for setting a trust applied by an air leg to a rock drill and the other for retracting the air leg without affecting the thrust setting achieved by operation of the first control. The first manual control is in the form of a twist-grip control (53) which is arranged to set the axial position of a spring-biased valve spool (30) in the valve (22) via a pin (50) and a plunger (46). The plunger (46) also forms the second of the manual controls and can be pressed against the spring-biased valve spool (30) to vary the axial position of this spool.

7 Claims, 2 Drawing Sheets

ROCK DRILL AIR LEG CONTROL SYSTEM

BACKGROUND OF THE INVENTION

This invention relates to a rock drill air leg control system.

Conventional pneumatic rock drills have an air leg which is mounted pivotally to the drill proper. In use, the lower end of the air leg is spragged, i.e. engaged with the floor or footwall of a mine working where drilling is taking place. The air leg is supplied with compressed air from the same source as the rock drill proper and can be extended or retracted by appropriate manipulation of a twist-grip controlled valve. During extension, the spragged air leg supplies thrust to the rock drill which assists in the drilling operation When the air leg reaches the end of its design stroke, it has to be retracted and re-spragged closer to the working face before drilling can resume. This is achieved by manipulating the twist-grip controlled valve to regulate the supply of compressed air such that the air leg retracts.

A problem associated with the known system described above is that when the air leg is retracted using the twist-grip controlled valve the original thrust setting is lost. Accordingly, each time the drilling operation is restarted after re-spragging, time is wasted while the operator of the rock dill tries to get back to the previous thrust setting for optimal drilling.

In a more sophisticated arrangement exemplified by the applicants S250 rock drill a dual valve system is used. In this valve system there is a twist-grip controlled valve for regulating the trust setting and a separate, second valve for retracting the air leg when re-spragging is to be carried out. Since the twist-grip controlled valve need not be manipulated during re-spragging, the original thrust setting can be maintained.

SUMMARY OF THE INVENTION

According to the invention there is provided a rock drill air leg control system comprising a single valve having a it manual control for setting a thrust applied by an air leg to a rock drill and a second manual control for retracting the air leg without affecting the thrust setting achieved by operation of the first control.

In a preferred embodiment, the single valve is a spool valve having a spring-biased valve spool, the first control is a twist-grip control operable to set the axial position of the spool and the second control comprises an axially slidable operating member, possibly in the form of an elongate plunger, which acts upon the valve spool to vary the anal position of the valve spool.

In one arrangement which is particularly preferred, the spring bias on the valve spool biases the operating member against a detent which is engaged by a thread on a rotatable twist grip of the twist-grip control and which is capable of limited movement relative to the operating member, whereby rotation of the twist grip causes the detent to move so as to set the position of the operating member and valve spool, and whereby the operating member can be moved relative to the detent to cause corresponding movement of the valve spool.

Typically, the twist grip is hollow and the operating member is arranged to extend through the hollow twist grip.

The control system of the invention may be housed at least partially in a cavity in the backhead of the rock drill.

BRIEF DESCRIPTION OF THE DRAWINGS

The invention will now be described in more detail, by way of example only, with reference to the accompanying drawings in which.

DESCRIPTION OF A PREFERRED EMBODIMENT

Figure 1:
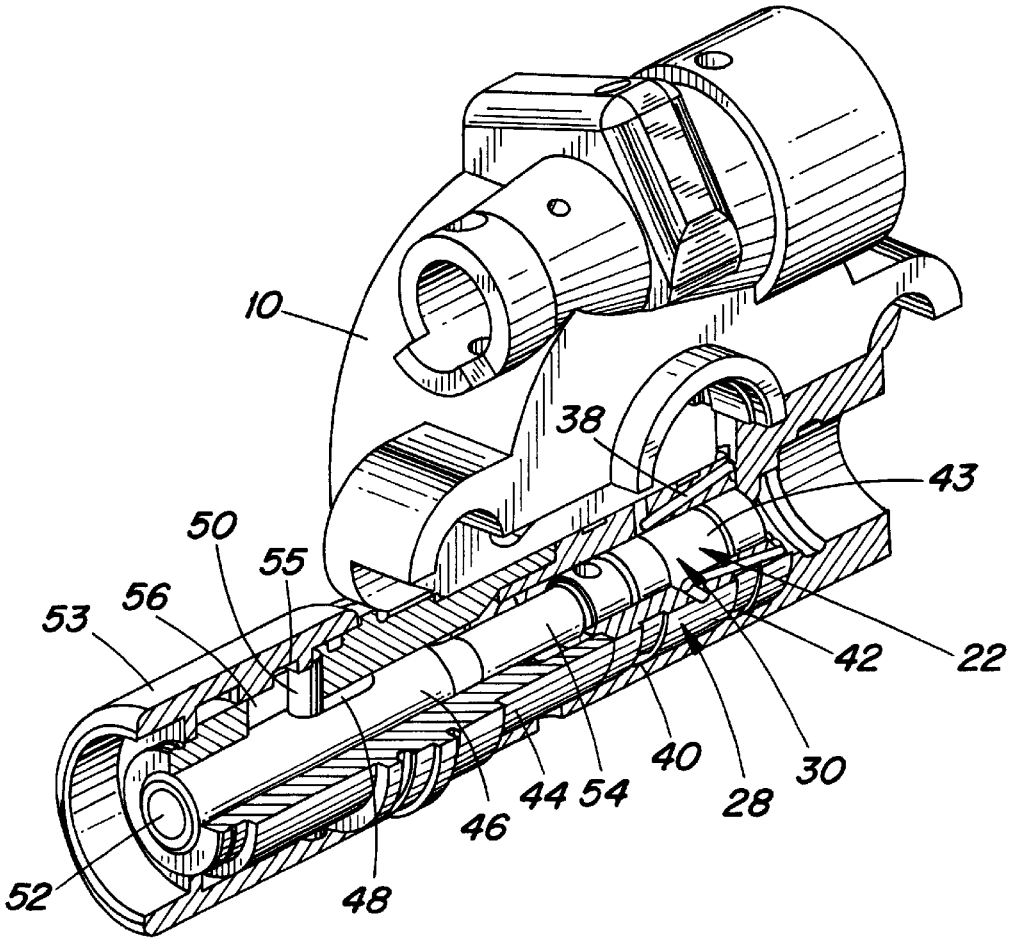
FIG. 1 shows a sectioned perspective view of a rock drill air leg control system according to the present invention.

In FIG. 1 the backhead of a pneumatic rock drill is designated with the reference numeral 10. Since the present invention is primarily concerned with the nature of a system used to control a rock drill air leg, the remainder of the rock drill 10 is not shown. The air leg itself is illustrated diagrammatically in FIG. 2 and is indicated with the reference numeral 12.

Figure 2:
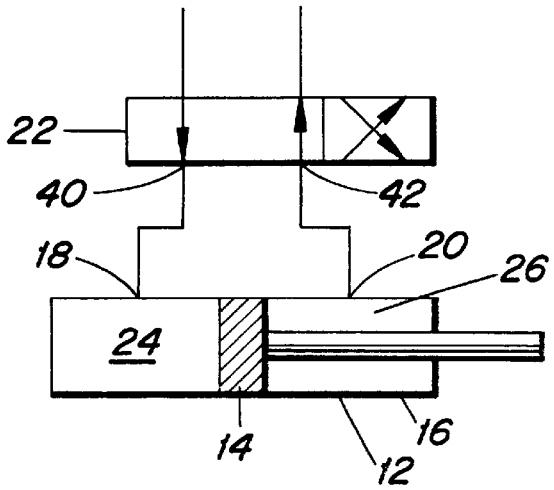
FIG. 2 shows, diagrammatically, the operation of a valve forming part of the control system of the invention.

Referring to the diagrammatic illustration in FIG. 2, the air leg 12 includes a piston 14 which is reciprocable within a cylinder 16 and a pair of ports 18 and 20 which communicate with the interior of the cylinder on opposite sides of the piston, as shown. The cylinder 16 is supplied with compressed air from the same source as is used to supply the percussive and rotary mechanisms of the rock drill itself under the control of a spool valve 22.

When the spool valve 22 is set to supply compressed air through the port 18 to a chamber 24 on one side of the piston 14, the piston is urged to the right in FIG. 2 and air in a chamber 26 on the other side of the piston is exhausted through the spool valve. This movement of the piston 14 corresponds to extension of the air leg, as would be the case during normal drilling operations when the air leg is extended to supply drilling thrust. Alternatively, when the spool valve is set to supply compressed air through the port 20 to the chamber 26, the piston 14 is driven to the left in FIG. 2 and air is exhausted through the spool valve from the chamber 24. This corresponds to retraction of the air leg, for instance when the air leg has reached the end of its operative stroke and is to be re-spragged to the floor or footwall of a mine working.

Figure 3:
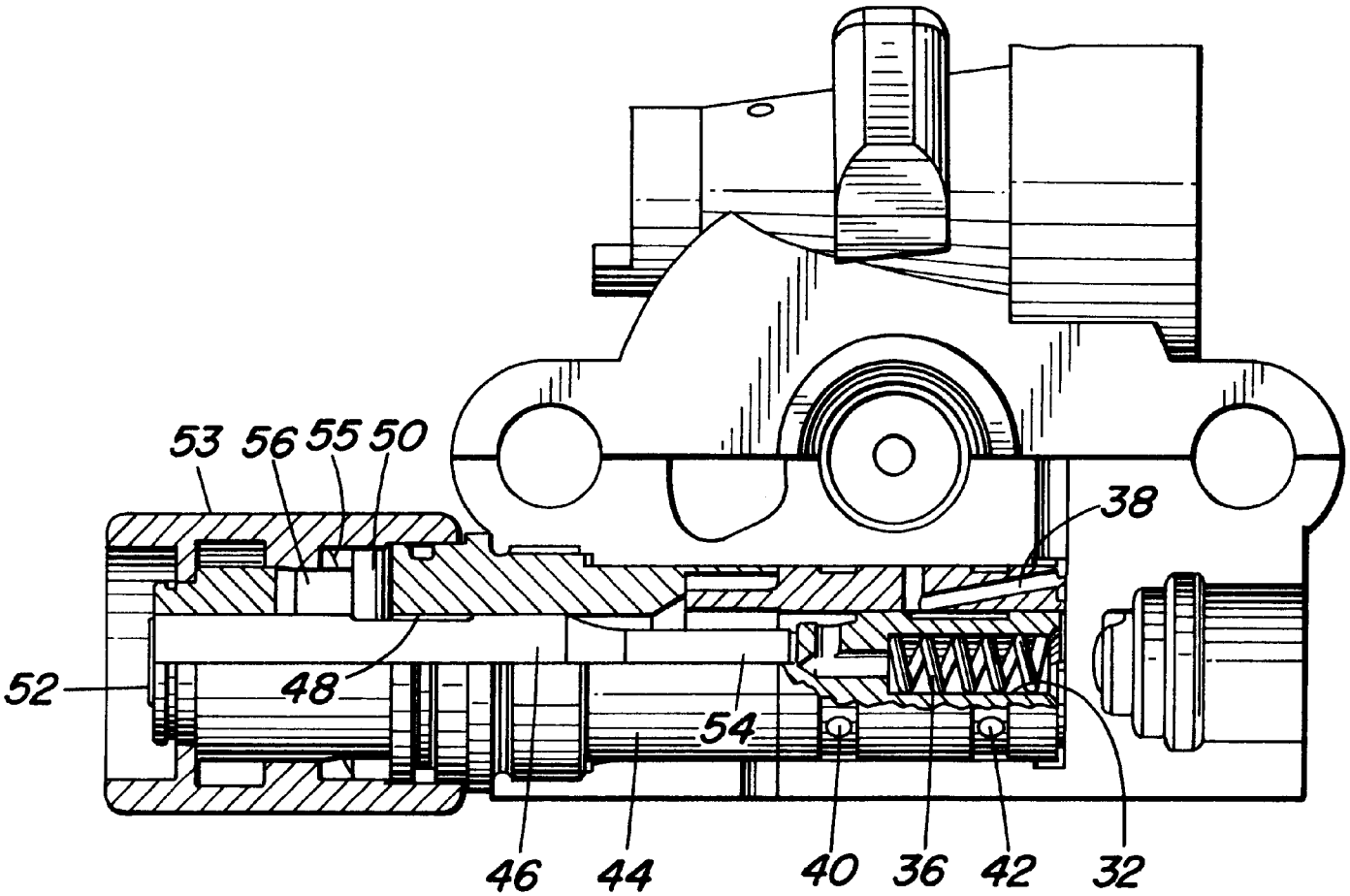
FIG. 3 shows a cross-sectional view of the control system of the invention, illustrating the operation of a single spool valve of the control system.

With reference now to FIG. 1 of the drawings, the spool valve 22 includes a sleeve 28 mounted in a cavity in the backhead 10 of the rock drill and a valve spool 30 which is slidable with the sleeve. The spool 30 is formed with a countersunk bore 32 (see FIG. 3), and a compression spring 36 located within the bore 32 serves to urge the spool to the left away from the base of the cavity in the backhead 10. The sleeve 28 is formed with inclined bores 38 which supply compressed air to the interior of this sleeve from an air passage in the backhead 10 leading from the compressed air source, and with radial bores 40 and 42. The inclined bores 38 communicate inside the sleeve with an annular recess 43 in the spool 30. If the spool 30 is in a left hand position (as illustrated in FIG. 2), the bore 40 is open to the spool recess 43 and the bore 42 is closed to this recess. Accordingly, compressed air leaves the spool valve through the port 40 which supplies it to the pot 18 of the air leg cylinder 16, thereby extending the air leg. In a right hand position of the spool (as illustrated in FIGS. 1 and 3) the ports 40 and 42 are closed and open, respectively, to the annular recess 43 so that compressed air leaves the spool valve 22 trough the port 42. In this case, the air is supplied to the port 20 of the air leg cylinder to retract the air leg.

The ports 40 and 42 are opened and closed by the action of the illustrated lands on either side of the annular recess 43 in the spool 30. In the extension mode, the degree to which the port 40 is opened to the recess 43, and accordingly the axial position of the spool 30, determines the strength of the airflow to the cylinder 16 and hence the drilling thrust supplied by the air leg. In accordance with the invention, the axial position of the valve spool 30 can be varied by the action of either one of two independent manual controls, as explained below in more detail.

A hollow valve shaft 44 is mated with the end of the sleeve 28 of the spool valve and projects from the cavity in the backhead 10 of the rock drill. Located slidably within the shaft 44 is an operating member in the form of an elongate plunger 46. The plunger 46 is formed with an elongate slot 48 extending diametrically through it and the valve shaft 44 includes an elongate slot 56 which has the same length as the slot 48. The slot 56 serves to define the maximum and minimum positions of a twist grip 53 which is described in more detail below. A diametrically oriented pin 50 extends through the slots 48 and 56, as illustrated, so as to project beyond the sure of the plunger 46. The plunger has an outer end 52 which is posed and an inner end 54 which contacts the outer end of the spool 30. Accordingly, the plunger 46 is also biased to the left by the action of the spring 36.

The twist grip 53 is formed internally with a two-start spiral thread 55 and the projecting ends of the pin 50 are engaged in the respective threads. The spring 36 biases the plunger 46 to the left such that the pin 50 locates at the right hand end of the slot 48. The position of the pin accordingly determines the normal axial position of the plunger 46 and hence of the valve spool 30. Since the projecting ends of the pin 50 are engaged in the respective threads 55, rotation of the twist grip 53 causes linear displacement of the pin and hence varies the axial position of the plunger 46 and the spool 30.

In operation, assuming that normal drilling is under way and the air leg is properly spragged, the operator of the rock drill grips and twists the twist grip 53 to set the positions of the pin 50, plunger 46 and spool 30 as desired to control the flow of compressed air to the cylinder 16 and hence the drilling thrust which the air leg supplies. When the air leg reaches the end of its normal stroke and re-spragging is necessary, the operator presses on the end 52 of the plunger 46 to push the plunger and the spool 30 to the right against the bias of the spring 36. When this occurs, the flow of air through the spool valve to the cylinder 16 is redirected so that the air leg is retracted. It will be appreciated that the operator has to hold the plunger in while retraction takes place. Thereafter, the end 52 of the plunger can be released to allow the plunger to return under spring bias to its normal position as determined by the position of the pin 50. As the plunger returns to its normal position, the air leg begins extending again for re-spragging.

It will be noted that the re-spragging operation is carried out without any variation to the rotational position of the twist grip 53. This is permitted by the slot 48 which allows lost motion to take place between the plunger 46 and the pin 50 when the plunger end 52 is depressed. Accordingly, the original thrust setting of the air leg is maintained throughout and the same thrust setting will be present when the drilling operation is started again.

An important advantage of the control system of the invention is that a single valve, i.e. the spool valve 22, is used to set the drilling thrust and to retract the air leg for re-spragging. This is achieved by two independently operable manual controls, namely the thrust setting control afforded by the twist grip 53 and the push-button air leg retraction control afforded by the plunger/spool combination. The fact that a single valve can be operated by independent controls to achieve both functions represents a cost saving when compared to dual valve, dual control arrangements such as that of the applicant's S250 rock drill. In addition to this, the single valve arrangement is less bulky than a dual valve system and contributes less to the overall mass of the rock drill. Also, the compact nature of the single valve, dual control arrangement proposed by the invention enables it to be incorporated in the backhead structure rather than in multiple, bulky housings projecting from the backhead, as is the case with the known S250 machine.

I claim:

1. A rock drill air leg control system comprising a single valve having a first manual control for setting a thrust applied by an air leg to a rock drill and a second manual control for retracting the air leg without affecting the thrust setting achieved by operation of the first control.

2. A control system according to claim 1, wherein the single valve is a spool valve having a spring-biased valve spool, the first control is a twist-grip control operable to set the axial position of the spool and the second control comprises an axially slidable operating member which acts upon the valve spool to vary the axial position of the valve spool.

3. A control system according to claim 2, wherein the axially slidable operating member is an elongate plunger.

4. A control system according to claim 2, wherein the spring bias on the valve spool biases the operating member against a detent which is engaged by a thread on a rotatable twist grip of the twist-grip control so that rotation of the twist grip causes linear displacement of the detent relative to the spool valve, and which is capable of limited movement relative to the operating member.

5. A control system according to claim 4, wherein the twist grip is hollow and the operating member is arranged to extend through the hollow twist grip.

6. A control system according to claim 5, wherein the detent comprises a pin which passes diametrically through an opening in the operating member and which engages the thread on the rotatable twist grip at each end of the pin.

7. A control system according to claim 1, wherein the control system is housed at least partially in a cavity in a rock drill backhead.

* * * * *